US005697424A

United States Patent [19]

Ferdinandsen et al.

[11] Patent Number: 5,697,424

[45] Date of Patent: Dec. 16, 1997

[54] METHOD AND SYSTEM FOR OPERATING MOLDING AND CASTING PLANTS

[75] Inventors: Henrik Holm Ferdinandsen, Copenhagen; Martin Bøjlund-Pedersen, Roskilde, both of Denmark

[73] Assignee: Dansk Industri Syndikat A/S, Herlev, Denmark

[21] Appl. No.: 555,403

[22] Filed: Nov. 9, 1995

[30] Foreign Application Priority Data

Nov. 18, 1994 [DK] Denmark ..... 1322/94

[51] Int. Cl.[6] ..... B22D 37/00; B22D 47/02

[52] U.S. Cl. ..... 164/456; 164/4.1; 164/154.1; 164/154.2; 164/154.6; 164/155.1; 164/155.4; 164/155.6; 164/457

[58] Field of Search ..... 164/456, 457, 164/4.1, 154.1, 155.1, 154.6, 155.4, 155.6, 154.2

[56] References Cited

U.S. PATENT DOCUMENTS

| | | | |
|---|---|---|---|
| 4,112,999 | 9/1978 | Gasper | 164/154.6 |
| 4,620,353 | 11/1986 | Pryor | 164/4.1 |
| 4,724,886 | 2/1988 | Sjodahl | 164/4.1 |
| 4,724,894 | 2/1988 | Sjodahl | 164/457 |
| 5,054,538 | 10/1991 | Ibsen | 164/154.1 |
| 5,062,465 | 11/1991 | Mortensen | 164/4.1 |
| 5,069,267 | 12/1991 | Larsen | 164/155.1 |
| 5,125,448 | 6/1992 | Jensen . | |

FOREIGN PATENT DOCUMENTS

| | | | |
|---|---|---|---|
| 0594308 | 4/1994 | European Pat. Off. . | |
| 60-154867 | 8/1985 | Japan | 164/457 |
| 63-268562 | 11/1988 | Japan | 164/457 |
| 1-262064 | 10/1989 | Japan | 164/457 |
| 4-157058 | 5/1992 | Japan | 164/154.2 |
| 4-190964 | 7/1992 | Japan | 164/456 |

*Primary Examiner*—J. Reed Batten, Jr.
*Attorney, Agent, or Firm*—Larson & Taylor

[57] ABSTRACT

In an automatically operating molding and casting plant comprising a molding station (01) for producing molds (not shown) by compressing mold sand, a pouring station (05) and an extraction station (10), the main new feature is one or a number of video cameras (03, 09) depicting one or a number of process steps and/or the results of same, transmitting the corresponding image information to central control means (13, 14, 15), in which the image information is compared to "ideal" image information, e.g. image information previously read-in and based on a process step proceeding correctly, and which on the basis of the results of the comparison controls the affected stations in such a manner that undesired operational states or defective castings are avoided.

10 Claims, 3 Drawing Sheets

METHOD AND SYSTEM FOR OPERATING MOLDING AND CASTING PLANTS

TECHNICAL FIELD

The present invention relates to a method of operating automatic molding and casting plants, said plants being of the kind comprising a molding station, an optional core-setting station, a pouring station, an extraction station and a conveyor for conveying molds or mold parts produced in the molding station through the other stations in succession.

BACKGROUND ART

As is well-known, plants of the kind referred to initially are capable of producing castings at a high working rate, but up to the present, they have in certain respects been relatively vulnerable to irregularities arising in one or some of the process steps being carried out successively during the operation of the plant.

Thus, it may happen, without the operator immediately noticing it, that when the newly compacted mold part is liberated from the pattern or patterns, about or against which it has been formed by compressing mold sand, that some of the mold sand adheres to the pattern, thus producing a recess in the casting cavity formed and unavoidably causing a corresponding projection to be formed on the casting. Such a casting may, of course, be discarded and recycled as casting metal or possibly post-processed, but the situation is worse, if the recess lies below in the casting cavity and is open downwardly, as in this case it is highly probable that the metal having been poured in flows out of the mold and possibly solidifies in the conveyor below, resulting in a prolonged interruption of the production.

Defective casings can also occur, if any cores being used have been misplaced or are missing or are themselves defective in one way or another.

DISCLOSURE OF THE INVENTION

On the background of the above, it is the object of the present invention to provide a method of the kind referred to initially, with which it is possible to ascertain the occurrence of any irregularities with certainty and at such an early stage, that it is possible to prevent them from causing prolonged interruptions in the operation or other serious problems, and this object is achieved by proceeding in the manner set forth below. By exploiting modern image-forming technology in the manner set forth, e.g. by using so-called video cameras, it is possible to carry out a continuous monitoring of the processes in which irregularities may occur, e.g. of the kind referred to above.

In accordance with one aspect of the invention a method is provided for operating an automatic molding and casting plant wherein a production monitoring means is provided for monitoring plant production and wherein a plurality of successive operations are carried out in a plurality of stations, said plant including: a molding station including means for compressing particulate material against at least one pattern so as to form a mold or mold part with at least one casting cavity, the shape of said cavity corresponding to at least part of the casting to be produced, a pouring station including means for pouring liquid metal into the mold coming from the molding station, and an extraction station including means for extracting the castings from the molds coming from the pouring station, said plant further including conveying means for conveying the molds or mold parts produced in the molding station through said pouring station and said extraction station in succession, and said method comprising the steps of monitoring at least one of the operations being carried out in at least one of said stations so as to produce information corresponding to said monitoring, comparing said information so produced to previously stored information corresponding to a desired performance to determine the difference between the produced information and said stored information, and determining whether said difference exceeds a predetermined acceptable limit and, when said limit is exceeded, transmitting corrective commands to the at least one station being monitored.

The improvement of the invention in said method is the monitoring step comprises monitoring at least one pattern associated with the mold or mold part of a particular shape so as to produce corresponding information, the comparing step comprises comparing said corresponding information to previously stored pattern information corresponding to a pattern of the same shape without any adhering material so as to determine a pattern difference, and the determining and transmitting steps comprise determining whether said pattern difference exceeds an acceptable level and in a situation (a) where said level is exceeded, and only one single pattern is present, transmitting a command to the pouring station to omit pouring into the casting cavity formed by said single pattern, while in a situation (b) where said level is exceeded and a plurality of patterns are present and a determination is made that the deviation in the pattern difference from said acceptable level lies within predetermined limits, not transmitting a command to the pouring station to omit pouring into the casting cavity, said method further comprising transmitting, in both situations (a) and (b), a message to said production monitoring means comprising one of (i) a casting will be missing and (ii) at least one defective casting will be produced.

Preferably, said plant includes a core-setting station including means for placing cores in desired locations in casting cavities and the operation at said core-setting station is monitored. Advantageously, the core-setting station is part of the molding station. Preferably, when said comparing step reveals at least one pattern difference, a command is transmitted to a cleaning means to clean the at least one pattern being monitored, and said at least one pattern difference is displayed.

Preferably, if the comparing step reveals a difference lying in an interval between an acceptable level and a further level based on what can be accepted after post-processing of the corresponding casting, a command is transmitted to post-processing means to carry out a post processing step bringing the casting at least to said acceptable level, said post-processing means being controlled in dependence upon the observed position of differences revealed by the comparing step such that only parts of the casting exhibiting said differences will be post-processed.

According to a further aspect of the invention, a system is provided for operating an automatic molding and casting plant, said plant comprising:

a molding station including means for compressing particulate material against at least one pattern so as to form a mold or mold part with at least one casting cavity, the shape of said cavity corresponding to at least a part of the casting to be produced, a pouring station including means for pouring liquid metal into molds coming from the molding station, an extraction station including means for extracting castings from the molds coming from the pouring station, and conveying means for conveying the molds or mold parts produced in the molding station through said pouring station and said extraction station in succession, said system comprising at least one camera, having a field of vision disposed such that said field of vision encompasses an aspect of interest of an operation being carried out in one of the stations, for producing corresponding camera image information regarding said aspect of interest, comparing means for comparing said camera image information to previously stored image information corresponding to a desired performance of said aspect, and for producing an output in accordance therewith, and control means for evaluating said output and, if the said output reveals a difference beyond a predetermined acceptable level, for transmitting a corrective command to the at least one station, said control means transmitting a command to said pouring station to omit pouring into the casting cavity in a situation (a) where said difference exceeds said acceptable level and a only single casting pattern is present, and not transmitting a command to said pouring station to omit pouring in a situation (b) where said difference exceeds said acceptable level, but where a plurality of casting patterns are involved, and where said difference deviates from said acceptable level by an amount which lies between predetermined limits, said control means further providing, in both situations (a) and (b), a message to a production monitoring means of said plant, said message comprising one of: (i) a casting will be missing and (ii) at least one defective casting is being produced.

In accordance with yet another aspect of the invention, a system is provided for operating an automatic molding and casting plant, said plant comprising: a molding station including means for compressing particulate material against at least one pattern so as to form a mold or mold part with at least one casting cavity, the shape of said cavity corresponding to at least a part of the casting to be produced, a pouring station including means for pouring liquid metal into molds coming from the molding station, an extraction station including means for extracting castings from the molds coming from the pouring station, and conveying means for conveying the molds or mold parts produced in the molding station through said pouring station and said extraction station in succession, and said system including: monitoring means for monitoring an aspect of interest of an operation being carried out in one of the stations, and for producing corresponding image information, comparing means for comparing said image information to previously stored image information corresponding to a desired performance of said aspect and for producing an output in accordance therewith, and control means for evaluating said output and, if the said output reveals a difference beyond a predetermined acceptable level, for transmitting a corrective command to the at least one station, said control means transmitting a command to said pouring station to omit pouring into the casting cavity in a situation (a) where said difference exceeds said acceptable level and a only single casting patterns is present, and not transmitting a command to said pouring station to omit pouring in a situation (b) where said difference exceeds said acceptable level, but where a plurality of casting patterns are involved, and where said difference deviates from said acceptable level by an amount which lies between predetermined limits, said control means further providing, in both situations (a) and (b) a message to a production monitoring means of said plant, said message comprising one of: (i) a casting will be missing and (ii) at least one defective casting is being produced, said system further including: a parameter recorder for receiving data from at least one station, and a data processing unit, connected to said parameter recorder, for processing data received from the said recorder, said control means including a control unit connected to said data processing unit, for supplying control signals to at least one station in dependence on the data received from said data processing unit, said monitoring means comprising a monitoring camera producing image information and having an output connected to an input of said parameter recorder, at least one of said parameter recorder and said data processing unit comprising data storage means for storing image information relating to a correctly performed operation, comparing means for comparing the image information produced by the monitoring camera to the image information stored in said data storage means, and decision means for deciding on the basis of externally input decision criteria whether the result of said comparing by said comparing means calls for influencing at least one station and, if so, transmitting corresponding signals to the said control unit, said control unit transmitting, on the basis of the signals received from said decision means, control signals to at least one station to be influenced.

Preferably, the parameter recorder, the data processing unit and the control unit are constituted by programs read into a computer comprising an associated data input unit and a display unit.

Preferably, the image information from the at least one camera is processed in the data processing unit by optical framing, and is displayed on at least one data screen in the display unit.

Preferably, at least one camera comprises a camera sensitive to thermal radiation.

BRIEF DESCRIPTION OF THE DRAWINGS

In the following detailed portion of the present description, the invention will be explained in more detail with reference to the exemplary embodiment of a system and an associated plant for carrying out the method according to the invention shown in the drawing, in which FIG. 1 diagrammatically shows the parts of a plant comprising the system according to the invention necessary for understanding the invention, FIG. 2 likewise diagrammatically shows how the molds used in the plant shown in FIG. 1 may be provided with marks, FIGS. 3–6 likewise diagrammatically show some of the existing possibilities of mold sand adhering to patterns.

DESCRIPTION OF THE PREFERRED EMBODIMENT

Figure 1:
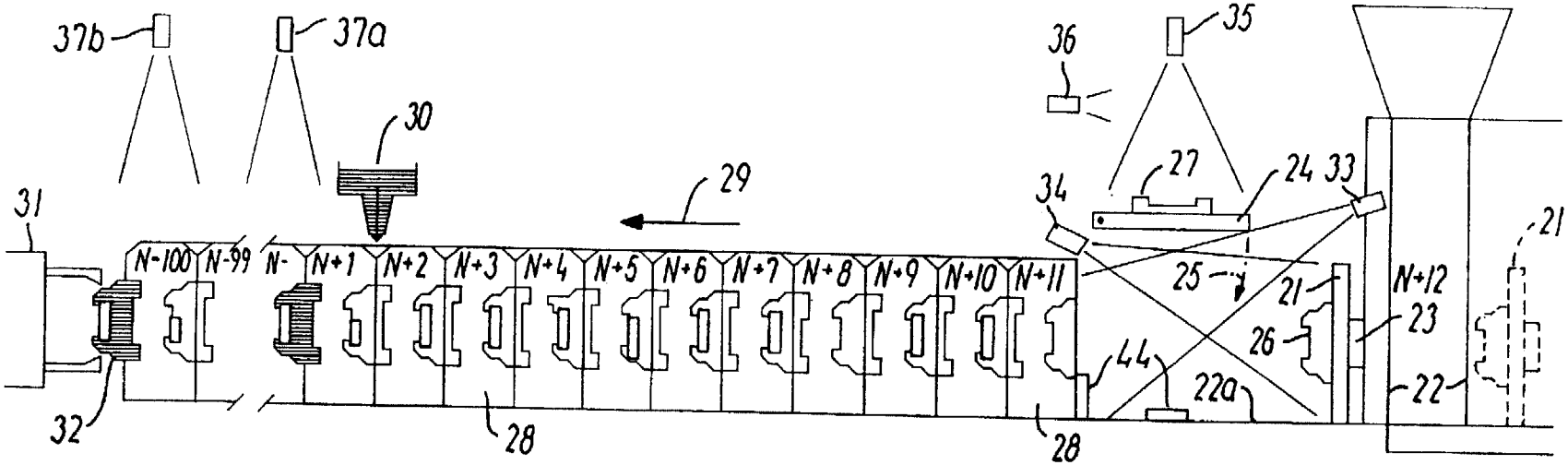

The plant shown in FIG. 1 comprises, in its end situated on the extreme right in the drawing, a molding press, that may be of a known type, the main components of which are

- a squeeze plate 21 movable into and out of the molding chamber 22 along a bottom plate **22*a* by the piston rod 23** in a hydraulic cylinder (otherwise not shown), as well as
- a pivoted squeeze plate 24, as indicated by an arrow 25 being capable of being pivoted downwardly and moved in towards the molding chamber 22 to a position (not shown), in which it sands facing the squeeze plate 21 at a distance equal to the thickness of a mold, the squeeze plate 21 then standing in a withdrawn position indicated in dotted lines in the molding chamber 22.

In said positions of the squeeze plate and the movable squeeze plate, a mold or a mold part for casting is produced from mold sand (not shown) having been introduced into the molding chamber 22 by means of suitable devices (not shown), said mold sand being compressed between the squeeze plate 21 and the pivoted plate 24 and the patterns 26 and 27, respectively, secured to these plates. Accordingly, in the examples shown, a double mold part will be formed, normally having the shape of the mold part 28 at the present moment being closest to the molding chamber 22.

By means of a conveyor (not shown), the mold parts 28 are conveyed in the direction of the arrow 29 towards and into a pouring station 30, in which molten metal is poured in a manner known per se in the casting cavities having been formed in the mutually abutting mold parts 28 by the patterns 26 and 27.

From the pouring station 30, the molds are conveyed further to an extraction station 31, in which the castings 32 are liberated from the mold parts and any cores, normally by crushing the mold parts and the cores.

What has been described up to this point with reference to FIG. 1 is in principle part of the prior art, e.g. represented by the automatic foundry plants known under the trademark DISAMATIC®.

According to the present invention, the plant also comprises a number of cameras, in the example shown 5, e.g. so-called video cameras, viz.:

- a first camera 33 having a field of vision comprising the region, in which the pivoted squeeze plate 24 will be in its downwardly pivoted position (not shown), said region in this downwardly pivoted position of the pivoted plate comprising "the rear side" of the mold part 28 being closest to the molding chamber 22, i.e. being that most recently produced, the mold part 28 having a pattern impression from the pattern 26, as well as any cores placed in the mold part,
- a second camera 34 having a field of vision comprising the front side of the most recently produced mold part with a pattern impression of the pattern 27 prior to the mold being moved forward by the squeeze plate 21 and—of course—the pattern 26 secured thereto, during the return movement of the squeeze plate 21 into the molding chamber,
- a third camera 35 having a field of vision comprising the pressing side of the pivoted plate 24 with the latter in its upwardly pivoted position as shown and—of course—the pattern 27 secured thereto,
- a fourth camera 36 for monitoring cores in the core mask of the core setter, and finally
- a fifth camera 37*a* and a sixth camera 37*b* having fields of vision comprising regions on those mold parts having had identification marks placed upon them after having passed the pouring station 30.

It is also possible to use heat-sensitive cameras (not shown) having "fields of vision" comprising regions with hot molds and/or castings and being capable of forming "thermal images" of the regions concerned, especially with a view to supplying control data for the extraction unit.

Figure 11:
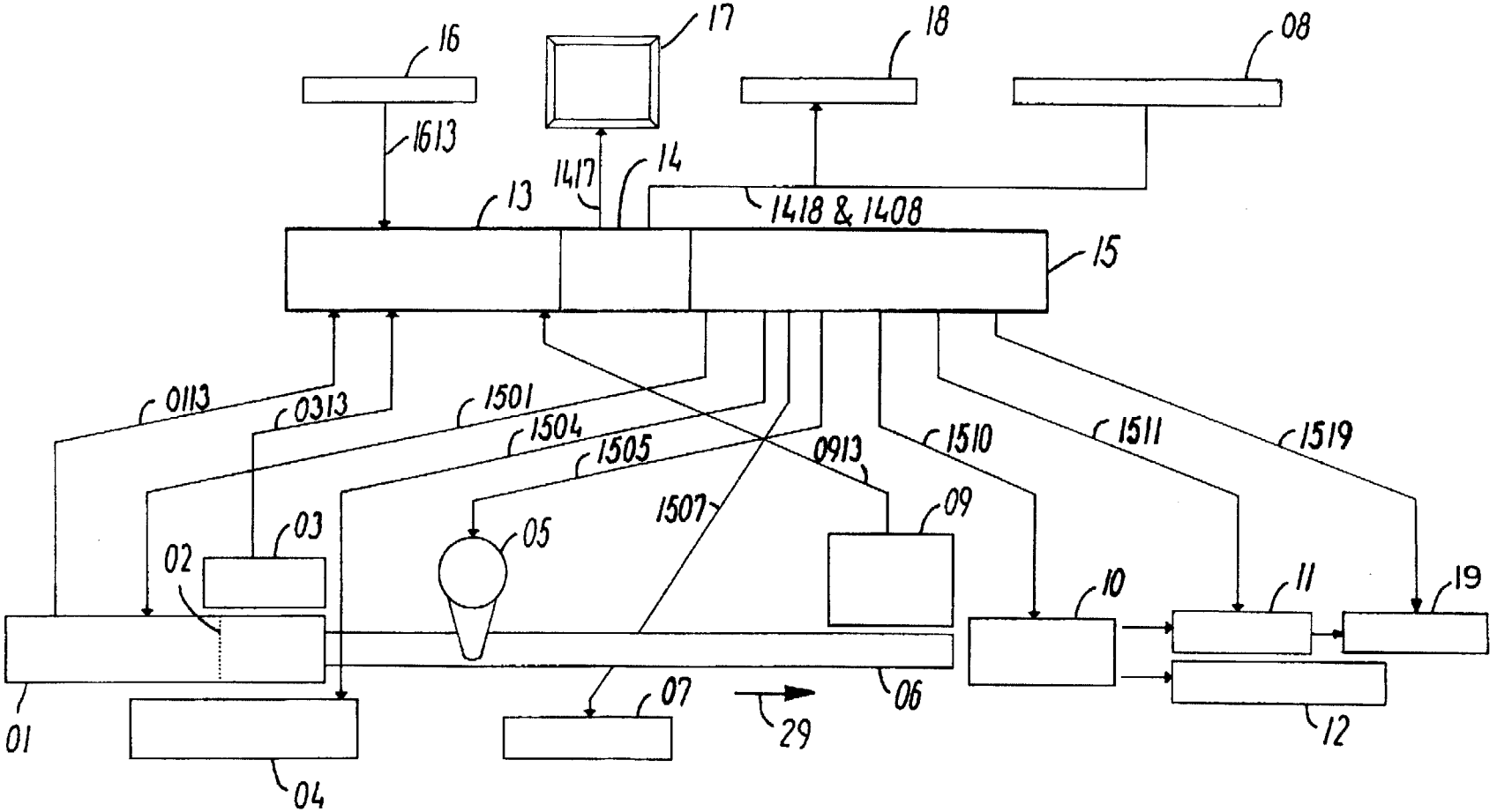

Reference is now made to FIG. 11 as an example of how the equipment shown in FIG. 1 may form part of an automatically operating molding and casting plant of the kind disclosed in U.S. Pat. No. 5,054,538 referred to initially.

Thus, the plant shown in FIG. 11 comprises

- a molding station 01, in the example shown being integrated with a core setter 02,
- the camera group 03 as proposed according to the invention and comprising the first through fourth cameras 33–36 described with reference to FIG. 1,
- a pattern cleaning station 04, according to the invention being proposed for use in cleaning patterns, when it receives certain signals based on image information from the camera group 03,
- a pouring station 05 corresponding to the pouring station 30 shown in FIG. 1, adapted to pour molten metal into casting cavities in mods (not shown) being conveyed in the form of a so-called mold string on
- a mold conveyor 06 through
- a mold marking station 07 and from there to
- a mold identification station 09, in which the molds are identified by means of the marks they have been provided with in the mold marking station 07, and finally to
- an extraction station 10 corresponding to the extraction station 31 shown in FIG. 1, in which the castings are liberated as described with reference to FIG. 1.

Upon leaving the extraction station 10, the castings are sorted and divided into two categories, the latter being conveyed to either

- a casting marking station 11 for castings in the category not to be discarded, or
- a recycling station 12, from which defective castings are returned to the pouring station 05 in the form of molten metal, using suitable equipment (not shown).

Castings having been provided with markings in the marking station 11 are conveyed to a grinding station 19, in which burrs, fins and flash, possibly also other unwanted projections, are removed by grinding.

The operation of the stations shown in FIG. 11 and described up to this point is controlled by means of an automatic control system consisting of

- a parameter recorder 13 adapted to receive data from the molding station 01, the camera group 03 and the mold identification station 09 through conductors or other signalling connections 0113, 0313 and 0913, respectively, as well as from a data input unit 16 with which data may be inputted into the system,
- a computer 14 adapted to co-operate with the parameter recorder 13 as well as with a tool planning station 08, through connection 1408, and
- a control unit 15 capable of sending control signals to the molding station 01, the pattern cleaning station 04, the pouring station 05, the mold marking station 07, the extraction station 10, the casting marking station 11 and the grinding station 19 through conductors 1501, 1504, 1505, 1507, 1510, 1511 and 1519, respectively.

Further, the computer 14 is connected through conductors 1417 and 1418 to

- a display unit 17, e.g. an image screen, keeping the operator informed about the instantaneous operative condition of the system, as well as
- a statistics unit 18 adapted for statistical processing of data from the computer 14, e.g. with a view to establishing the frequency of various faults.

The display unit 17 may also be adapted to show a sequence of images from any camera, superimposed with an indication of comparison results by means of optical error marking or framing of detected faults.

Figure 3:
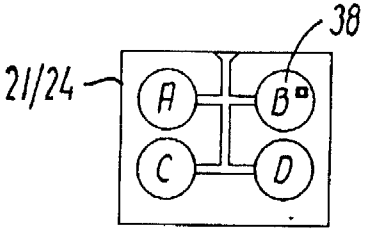
Figure 4:
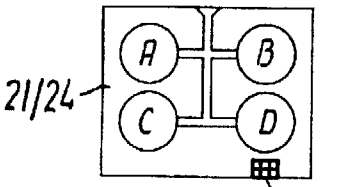

FIGS. 3 and 4 diagrammatically show images that could have been recorded by the first camera 33 with the pivoted plate 24 in its downwardly pivoted position (not shown), or by the second camera 34 in the position of the squeeze plate 21 as shown. FIGS. 3 and 4 show four identically shaped patterns A, B, C and D accordingly occupying the place occupied by the pattern 27 or the pattern 26 in FIG. 1. FIG. 3 shows how a small sand body 38 has been observed on the pattern B, this accordingly signifying the presence of a corresponding depression in the mold having been formed using this pattern, this again leading to that the casting concerned will have an unwanted projection corresponding to the sand body 38.

In the parameter recorder 23 and/or the computer 14, the image data corresponding to FIG. 3 are compared to "ideal" image data inputted from the data input unit 16, and the program executing the comparison and analysing the latter may e.g. be adapted in such a manner, that no signal is sent to the pouring station 05/30 about not pouring the casing cavity concerned, but signals and/or image data are sent to the display unit 17 to warn the operator and to the extraction station 31 with data relating to the position and condition of the defective casting, so that the latter, depending on the extent of the defect, will either be conveyed through the casting marking station 11 to the grinding station 19, or to the recycling station 12 with a view to being returned to the casting metal. A signal is also sent to the pattern cleaning station 04 to remove the sand body 38.

FIG. 4 is an image corresponding to FIG. 3, but shows a much more serious situation, in which a sand body 39 having been found on the lower part of the pattern may signify that the casing in the corresponding place has been weakened to such a degree, that the casting metal will be able to penetrate the mold in this place. In such a case, signals will also be sent to warn the operator, to the pouring station to omit pouring and to the pattern cleaning station 04 to remove the sand body 39.

Figure 5:
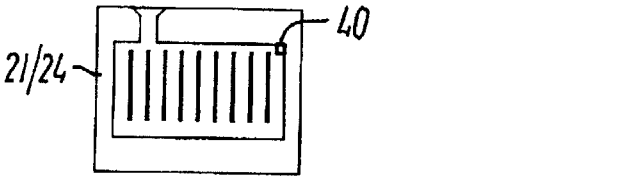

FIG. 5 shows a pattern plate with a pattern, to which a sand body 40 adheres. The defect caused by this sand body will not be sufficiently large to cause the casting concerned to be discarded, for which reason—corresponding to the situation shown in FIG. 3—no signal will be sent to the pouring station to omit pouring, but relevant signals will be sent to the extraction station 10 and the succeeding stations 11 and 19 that the requisite grinding-off is to be executed to make the casting acceptable. In this case also, signal is sent to the pattern cleaning station 04 to remove the sand body 40.

Figure 6:
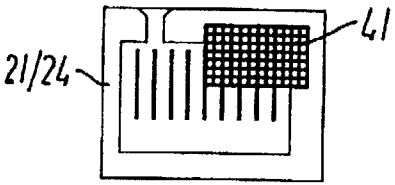

FIG. 6 shows a pattern plate with a pattern, on which a very large sand body 41 appears, signifying, or course, that the mold having been formed is unfit for use. For this reason, signal is sent to the pouring station to omit pouring and to the pattern cleaning station to remove the sand body 41, and further to the statistics unit is that a casting will be missing.

FIGS. 7–10 show diagrammatically various possible images of a mold part 28, in which a number of cores have been placed.

Figure 7:
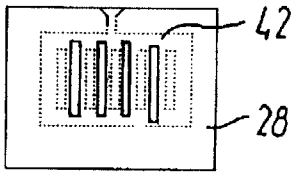
FIGS. 7–10 show various possibilities for cores being faulty or misplaced, and FIG. 11 in the form of a block diagram shows a system according to the invention produced by making certain alterations to a previously known system.
Figure 8:
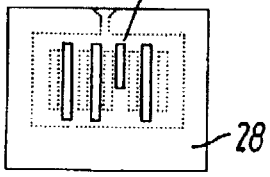

FIG. 7 shows a situation, in which a core 42 lies in a wrong position, while FIG. 8 shows a situation, in which a core 43 is defective; in both cases, signal is sent to the pouring station to omit pouring, warning signal to the machine operator and signal to the statistics unit 18 that a casting will be missing.

Figure 9:
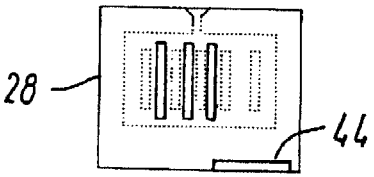

FIG. 9 illustrates a situation also indicated in FIG. 1, viz. that a core 44 has literally been lost. In such a situation, the computer 14 will interrupt the operation of the system and produce a warning signal on the display unit 17, since a loose core lying on the bottom of the moulding chamber 22 will make normal operation impossible.

Figure 10:
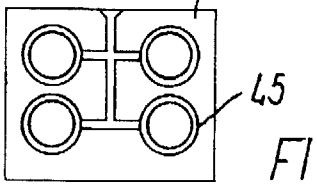

Finally, FIG. 10 shows a situation, in which cores, of which one core 45 lies in a wrong position, have been placed in a mold part 28 produced by using four identically shaped patterns, e.g. like the patterns A, B, C and D in FIGS. 3 and 4. In this case, the control system will react roughly in the same manner as described above with reference to FIG. 3, as in this case also, three flawless castings and one defective casting will be produced. Due to the asymmetrical placing of the core 45 it will, however, not be possible to "restore" the defective casting.

Figure 2:
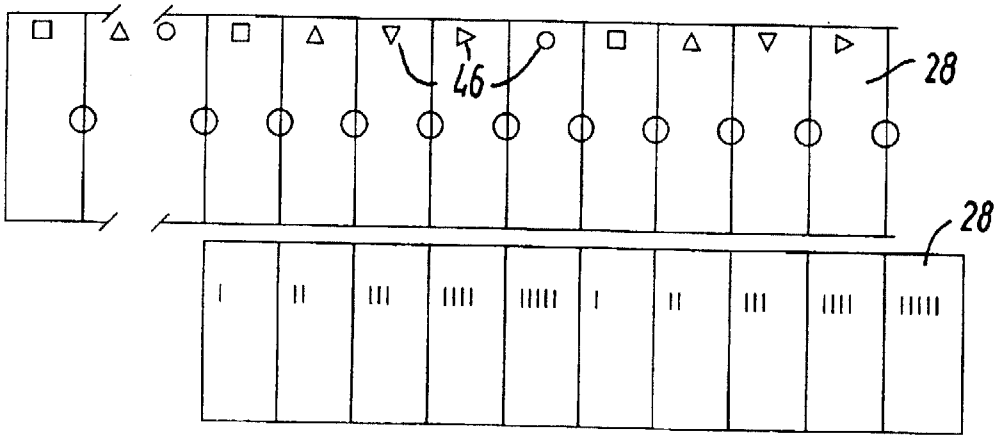

FIG. 2 shows diagrammatically and in a top and side view a part of the mold string consisting of mold parts 29, it being noted that this part of the mold string lies downstream of the pouring station 30. By means of the mould marking station 07 shown solely in FIG. 11, a number of marks 46, that may be in the form of small labels or badges, are placed on top of the mold parts 28 to be provided with marks, the latter for each mold part containing the relevant data supplied through the control unit 15. If—what is preferred—the relevant data for the individual mold parts 28 exist in the form of data files associated with the individual mold parts and being supplied to the computer 14 in a "queue", the marks 46 need not contain these data, but solely data about their number in the sequence of the mold part concerned. The lower part of FIG. 2 shows how it is possible to inscribe the numbers in the sides of the mold parts in the form of a corresponding number of lines.

In addition to analysing the errors occurring, the statistics unit 18 may be used for storing information relating to the individual castings having been produced, making it possible at some later time to call forth information about e.g. castings having proved unable to comply with the specifications, e.g. because of hidden faults. Likewise, image sequences from the cameras may be stored electrically in a known manner and/or transferred in real time to computers and/or display screens placed in "strategic" positions, in which they may easily be observed by the operator and/or his/her superiors.

The example described solely comprises one single molding and casting plant controlled by an automatic control system, but the present invention also encompasses a group consisting of two or more such molding and casting plants controlled by a common control system.

We claim:

1. In a method of operating an automatic molding and casting plant wherein a production monitoring means is provided for monitoring plant production and wherein a plurality of successive operations are carried out in a plurality of stations, said plant including: a molding station including means for compressing particulate material against at least one pattern so as to form molds or mold parts with at least one casting cavity, the shape of said cavity corresponding to at least part of castings to be produced, a pouring station including means for pouring liquid metal into molds or mold parts formed at the molding station to produce the castings, and an extraction station including means for extracting, from the molds or mold parts, the castings produced at the pouring station, said plant further including conveying means for conveying the molds or mold parts produced in the molding station through said pouring station and said extraction station in succession, said method comprising the steps of: monitoring at least one of the operations being carried out in at least one of said stations so as to produce information corresponding to said monitoring, comparing said information so produced to previously stored information corresponding to a desired performance to determine the difference between the produced information and said stored information, and determining whether said difference exceeds a predetermined acceptable limit and, when said limit is exceeded, transmitting corrective commands to the at least one station being monitored, the improvement in said method wherein:

the monitoring step comprises monitoring at least one pattern associated with the molds or mold parts of a particular shape so as to produce corresponding information, the comparing step comprises comparing said corresponding information to previously stored pattern information corresponding to a pattern of the same shape without any adhering material so as to determine a pattern difference, and the determining and transmitting steps comprise determining whether said pattern difference exceeds an acceptable level and in situation (a) where said level is exceeded, and only one single pattern is present, transmitting a command to the pouring station to omit pouring into the casting cavity formed by said single pattern, while in situation (b) where said level is exceeded and a plurality of patterns are present and a determination is made that the deviation in the pattern difference from said acceptable level lies within predetermined limits, not transmitting a command to the pouring station to omit pouring into the casting cavity, said method further comprising transmitting, in both situations (a) and (b), a message to said production monitoring means comprising one of (i) a casting will be missing and (ii) at least one defective casting will be produced.

2. A method according to claim 1, wherein said plant includes a core-setting station including means for placing cores in desired locations in casting cavities and said method further comprises monitoring operations at said core-setting station.

3. A method according to claim 2 wherein the core-setting station is part of the molding station.

4. A method according to claim 1, wherein when said comparing step reveals at least one pattern difference, a command is transmitted to a cleaning means to clean the at least one pattern being monitored, and said at least one pattern difference is displayed.

5. A method according to claim 1 wherein, if the comparing step reveals a difference lying in an interval between an acceptable level and a further level based on what can be accepted after post-processing of the corresponding casting, a command is transmitted to post-processing means to carry out a post processing step bringing the casting at least to said acceptable level, said post-processing means being controlled in dependence upon the observed position of differences revealed by the comparing step such that only parts of the casting exhibiting said differences will be post-processed.

6. An automatic molding and casting plant comprising:

a molding station including means for compressing particulate material against at least one pattern so as to form molds or mold parts with at least one casting cavity, the shape of said cavity corresponding to at least a part of castings to be produced, a pouring station including means for pouring liquid metal into molds or mold parts formed at the molding station to produce the castings, an extraction station including means for extracting, from the molds or mold parts, the castings produced at the pouring station, conveying means for conveying the molds or mold parts formed at the molding station through said pouring station and said extraction station in succession, and a system for operating said plant, said system comprising at least one camera, having a field of vision disposed such that said field of vision encompasses an aspect of interest of an operation being carried out in one of the stations, for producing corresponding camera image information regarding said aspect of interest, comparing means for comparing said camera image information to previously stored image information corresponding to a desired performance of said aspect and for producing an output in accordance therewith, and control means for evaluating said output and, if the said output reveals a difference beyond a predetermined acceptable level, for transmitting a corrective command to the at least one station, said control means transmitting a command to said pouring station to omit pouring into the casting cavity in a situation (a) where said difference exceeds said acceptable level and a only single casting pattern is present, and not transmitting a command to said pouring station to omit pouring in a situation (b) where said difference exceeds said acceptable level, but where a plurality of casting patterns are involved, and where said difference deviates from said acceptable level by an amount which lies between predetermined limits, said control means further providing, in both situations (a) and (b), a message to a production monitoring means of said plant, said message comprising one of: (i) a casting will be missing and (ii) at least one defective casting is being produced.

7. An automatic molding and casting plant comprising:

a molding station including means for compressing particulate material against at least one pattern so as to form molds or mold parts with at least one casting cavity, the shape of said cavity corresponding to at least a part of the castings to be produced, a pouring station including means for pouring liquid metal into molds or mold parts formed at the molding station to produce the castings, an extraction station including means for extracting, from the molds or mold parts, the castings produced at the pouring station, conveying means for conveying the molds or mold parts formed at the molding station through said pouring station and said extraction station in succession, and a system for operating the plant, said system including: monitoring means for monitoring an aspect of interest of an operation being carried out in one of the stations, and for producing corresponding image information, comparing means for comparing said image information to previously stored image information corresponding to a desired performance of said aspect and for producing an output in accordance therewith, and control means for evaluating said output and, if the said output reveals a difference beyond a predetermined acceptable level, for transmitting a corrective command to the at least one station, said control means transmitting a command to said pouring station to omit pouring into the casting cavity in a situation (a) where said difference exceeds said acceptable level and a only single casting patterns is present, and not transmitting a command to said pouring station to omit pouring in a situation (b) where said difference exceeds said acceptable level, but where a plurality of casting patterns are involved, and where said difference deviates from said acceptable level by an amount which lies between predetermined limits, said control means further providing, in both situations (a) and (b) a message to a production monitoring means of said plant, said message comprising one of: (i) a casting will be missing and (ii) at least one defective casting is being produced, said system further including:

a parameter recorder for receiving data from at least one station, and a data processing unit, connected to said parameter recorder, for processing data received from the said recorder, said control means including a control unit connected to said data processing unit, for supplying control signals to at least one station in dependence on the data received from said data processing unit, said monitoring means comprising a monitoring camera producing image information and having an output connected to an input of said parameter recorder, at least one of said parameter recorder and said data processing unit comprising data storage means for storing image information relating to a correctly performed operation, comparing means for comparing the image information produced by the monitoring camera to the image information stored in said data storage means, and decision means for deciding on the basis of externally input decision criteria whether the result of said comparing by said comparing means calls or influencing at least one station and, if so, transmitting corresponding signals to the said control unit, said control unit transmitting, on the basis of the signals received from said decision means, control signals to at least one station to be influenced.

8. A plant according to claim 7, wherein the parameter recorder, the data processing unit and the control unit are constituted by programs read into a computer comprising an associated data input unit and a display unit.

9. A plant according to claim 7, wherein the image information from the at least one camera is processed in the data processing unit by optical framing, and is displayed on at least one data screen in the display unit.

10. A plant according to claim 7 wherein said at least one camera comprises a camera sensitive to thermal radiation.

* * * * *